United States Patent [19]

Kennon et al.

[11] 4,103,276

[45] Jul. 25, 1978

[54] RESISTOR CORE CABLE

[75] Inventors: James L. Kennon, Avon; Robert E. Sandorf, West Richfield, both of Ohio

[73] Assignee: Nordson Corporation, Amherst, Ohio

[21] Appl. No.: 705,363

[22] Filed: Jul. 14, 1976

[51] Int. Cl.[2] ..... H01C 3/06

[52] U.S. Cl. ..... 338/214; 239/15; 338/260

[58] Field of Search ..... 338/214, 260, 66; 239/15; 361/226–228

[56] References Cited

U.S. PATENT DOCUMENTS

| | | | |
|---|---|---|---|
| 3,045,199 | 7/1962 | Shobert | 338/260 |
| 3,167,255 | 1/1965 | Point et al. | 338/214 X |
| 3,348,186 | 10/1967 | Rosen | 338/214 |
| 3,657,520 | 4/1972 | Ragault | 338/214 X |
| 3,792,409 | 2/1974 | Smart et al. | 338/214 |

*Primary Examiner*—C. L. Albritton

*Attorney, Agent, or Firm*—George J. Coghill

[57] ABSTRACT

A high-voltage electrical cable comprising a core of alternating solid non-brittle resistors and flexible conductive links sheathed in a moderately flexible dielectric material has the relative physical dimensions of the components selected such that the mechanical stresses in the assembly are minimized if any loop in the cable were inadvertently pulled in such a way as to put a kink in the cable.

15 Claims, 3 Drawing Figures

RESISTOR CORE CABLE

BACKGROUND OF THE INVENTION

1. Field of the Invention

This invention relates generally to high voltage electrical cables used to connect an electrostatic spray coating gun to a high voltage power supply, and more particularly relates to a high voltage cable wherein the conductive path of the cable includes distributed solid resistors.

2. Description of the Prior Art

High voltage electrical cables comprising distributed solid resistors throughout the cable length have been known in both the automotive industry for spark plug cables, and in the electrostatic spray coating industry for high voltage electrical power cables. In the electrostatic spray coating industry such cables have been used for several years. For a discussion of the benefits of such cables to the Electrostatic Spray Coating Industry, reference can be made to U.S. Pat. No. 3,348,186 issued to S. R. Rosen and assigned to the assignee of the present invention. However, prior art cables such as this did exhibit drawbacks for which it is an object of this invention to overcome.

The prior art devices used in the Electrostatic Spray Coating Industry almost invariably used short (approximately 0.25 inches) carbon composition resistors connected by means of a short conductive link, with the whole assembly being sheathed along its length by a dielectric, such as polyethylene, of an appreciable thickness. Additional layers of other coverings were also used. For a discussion of the purposes of these additional coverings, reference can again be made to the above mentioned Rosen patent.

The carbon composition resistors were brittle, and therefore if the cable were stepped on or run over with a truck or the like they would fracture and hence could cause failure of the cable. Further, because there were so many resistors in such close proximity to each other, the cable itself was very stiff and bulky.

The dielectric sheathing might be considered flexible by some standards, but stiff by others. That is, it will bend, but if it has any appreciable radial thickness it would no be considered limp.

In normal use of these prior art cables it would not be uncommon for the cable to be looped randomly on the floor. Further, in normal use of these cables, it would not be uncommon for the cable to be pulled from an end with one of these loops still in the cable. If this happened, and there were no forces causing the loop to untwist, the loop would be pulled smaller as the pulling force increased. In the prior art cables one of the short brittle resistors might remain in the center or midpoint of the pulled loop where mechanical stresses resulting in the cable are greatest, resulting in fracture of the resistor. Even if the resistor were strong enough to withstand the mechanical stresses applied to it in midpoint of a pulled loop, severe deforming stresses could result in the polyethylene sheath which could adversely affect its insulating ability.

SUMMARY OF THE INVENTION

The present invention is an improved high voltage cable having distributed resistance along the electrical path of the cable. The cable consists of a core, continuously sheathed along its length by a resilient dielectric insulation.

The electrical path is through the core of the cable. The core comprises a series of individual, elongated, rigid, but non-brittle resistors connected end to end by means of flexible conductive links. In the preferred embodiment the resistors are made from fiberglass rod having a resistive ink applied to the surface of the rod, and having pin-like electrical connecting posts extending from the ends of the rod.

It has been found that as the length of the resistors is increased, holding all other factors the same, the tendency for a resistor to remain at the midpoint of a loop pulled from its ends decreases. Even if a resistor is at midpoint of a loop, prior to pulling the ends of the cable; upon pulling the ends of the cable, as might happen in an industrial use, the resistor is pulled out or "travels out" of the midpoint of the loop. The loop will form in the portion of the cable which contains the flexible conductive link. The worst case possible is that the midpoint of the pulled loop will occur at one end of the resistor; and this in and of itself results in less mechanical stress being applied to the dielectric sheath than occurred in the prior art cables. The mechanical stresses which do occur in the sheath are more evenly distributed along a greater length of the sheath.

In order to adequately reduce mechanical stresses in the dielectric sheath which result when a loop is pulled, the flexible conductive link betweeen resistors should be longer than the length of cable in a loop which has the minimum radius allowable for a similar cable assembly without the solid resistors. For purpose of this disclosure such a length can be defined as the "minimum allowable loop." For example, if the flexible portion of the cable can safely be subjected to a bend having a one inch radius of curvature, then the conductive links should be longer than a complete cable loop which could result in a one inch radius bend when the cable is pulled from its ends.

We have found that the dielectric sheathing materials in use today are made of materials such as polyethylene which exhibit some flexural elasticity. That is, upon being flexed from some preferred configuration the material will store energy just as any deformed spring will. The cable will take on a shape which minimizes the amount of energy stored. Stated in another way, when the cable is flexed forces will arise in the cable which would tend to cause the cable to return to its preferred configuration. Similarly, when a loop in a cable is pulled, the loop will take a shape which tends to minimize stored energy. If the cable is of uniform structure along its length, the loop will form into a smooth curve; the forces arising in the loop and the energy stored in the loop will be the same no matter which section of the cable contains the loop.

If, however, a flexurally elastic cable is not of uniform structure along its length, then the forces arising from a loop and the energy stored by a loop will depend on which section of the cable contains the loop. If the cable contains a section which has a higher modulus of flexural elasticity than an adjacent section, then the forces arising in the loop and the stored energy in the loop will be lower if the section having the higher modulus of elasticity is not in the loop. A non-brittle rigid resistor effectively produces a section of a cable having a higher modulus of flexural elasticity than adjacent sections. A situation where the resistor is right at the middle of the loop is unstable in a loop formed in an infinitely long cable with no frictional forces acting.

Therefore, if it were not for frictional type forces and boundary conditions, the loop would always "travel" to a point which minimized stored energy (e.g., in a cable having multiple identical solid resistors, the loop would "travel" to a point midway between two successive resistors). However, in any given cable of finite length and being governed by boundary conditions, and being under the influence of frictional forces, the instability of a resistor being located at the middle of a loop only exists for a given sized loop when the resistor is greater than some minimum length. This minimum length for instability to occur can be selected as a function of several different criteria, for example: loop size; some minimum radius bend in the cable at the end of the resistor; or the force exerted at the ends of the cable.

This minimum length is influenced by forces arising in the cable which resist the ability of the loop to "travel" and hence resist the ability of the loop to form in an orientation which reduces stored energy to the minimum possible value. Some of these forces are frictional in nature. They can arise from several sources: friction due to contact of the exterior of the cable with the surface on which the cable is lying; friction due to the contact of one part of the exterior of the cable to another part of the exterior of the cable where the loop crosses itself; frictional forces due to one layer of sheathing sliding over another layer when the cable is flexed; frictional type forces on the molecular lvel which resist flexing. There may be other resisting forces as well, including elastic forces, due to boundary conditions, tending to keep the resistor in the loop.

It is believed that in the cable of the present invention, as the length of the resistors is made longer, then the forces which arise in a loop containing a resistor and which tend to cause the loop to "travel," and which tend to reorient the loop with the resistor out of the loop, are increased. If the resistor is very short then these reorienting forces never exceed a value required to overcome the forces which resist this reorientation. In such a case, a resistor could remain in a small radius part or the midpoint of a pulled loop.

In the present invention the resistors are made long enough to result in forces which will cause a tightly pulled loop to orient itself with the resistor necessarily out of the midpoint or small radius part of the loop under normal use. By "normal use" it is meant that the cable is resting, possibly coiled, on an industrial type floor, without any outside forces (other than its own weight) increasing the fractional forces. If it is desired to cause the rigid section of the cable to ncessarily be out of the small radius part of a larger loop (or a loop less tightly pulled) then the length of the resistors needed would be greater.

It is an object of this invention to provide a cable having a flexurally elastic, uniform sheath and having rigid non-brittle resistors; where the forces arising from a pulled loop containing a resistor in the small radius part of the loop, and tending to cause the resistor to be in another position, will exceed the forces resisting this orientation when the loop is pulled in normal use. In such a case, a pulled loop with a resistor at the middle of the loop will be an unstable condition.

DESCRIPTION OF THE PREFERRED EMBODIMENT

Figure 1:
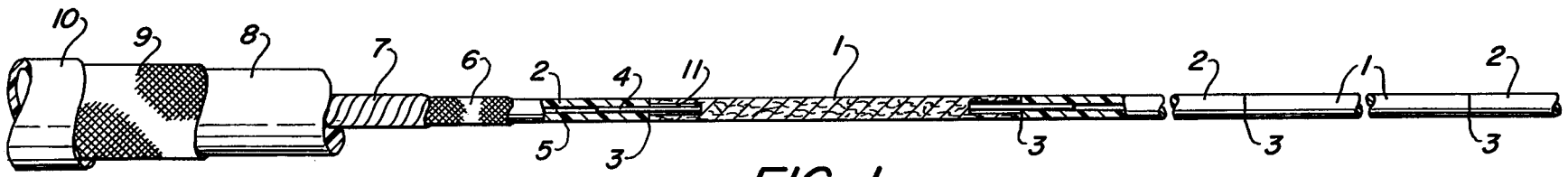
FIG. 1 shows a partial cross sectional view of a preferred embodiment of a solid resistor core cable.

Referring to FIG. 1, the constructional details of the cable can be observed. The cable consists of a central core comprising a series of elongated resistors 1 connected to each other by means of flexible conductive links 2. The resistors 1 comprise a fiberglass rod with resistive ink on the surface of the rod. The resistors 1 are elongated cylinders having electrically conducting pins 4 at each end typical of the connectors on any common resistor. Successive resistors 1 are electrically joined together by a conductive link 2. Vinyl, heavily loaded with carbon black, has been found to be a suitable material for use in forming the low resistance connecting links 2. This material is extremely flexible, is not subject to taking a set when flexed and has a low modulus of flexural elasticity. The conductive link 2 is circular in cross secton in a plane passing through the link 2 perpendicular to the plane of FIG. 1 and has a hollow center slightly smaller in diameter than the diameter of the connecting pins 4 on the resistors 1. The connecting pins 4 on the resistors 1 are inserted into the open hollow ends of the links 2 to make electrical contact with the link 2. The outside diameter of the link 2 is substantially identical to that of the resistor 1.

A fiber braid 6 is woven around the central conductive core to provide longitudinal stability during the manufacturing process. Dacron can be used to make the fiber braid 6.

A ribbon 7 is spirally wrapped around the fiber braid 6 with a 50% overlap for the entire length of the cable. The ribbon wrap helps to maintain a uniform outside diameter around the fiber braid 6. The ribbon 7 can be of a material known by the DuPont tradename Mylar.

A high molecular weight low density polyethylene sheathing 8 is extruded continuously around the ribbon wrap 7 to provide an electrical dielectric insulation of 0.1 inch wall thickness around the core, fiber braid 6 and ribbon wrap 7.

Polyethylene is used because it provides good electrical high voltage insulation, is moderately flexible, and will not permanently deform when flexed in normal use. The polyethylene is flexurally elastic.

A copper-weld braid 9 is woven around the polyethylene 8 for the length of the cable and is electrically connected to ground potential in use with an electrostatic spray coating system.

The entire assembly is then encased in a polyurethane jacket 10. The jacket provides abrasion resistance for the complete assembly.

For a more detailed description of the benefits and functional characteristics of this general type of cable, the above mentioned Rosen patent can be referred to, and therefore, is incorporated herein by reference.

In the preferred embodiment, the diameter of the resistors 1 and conductive links 2 is 0.094 inches. The polyethylene sheathing 8 has a radial thickness of 0.1 inches. With these dimensions it has been found that the minimum length of resistor which will necessarily become unstable at the center of the loop and travel out of a pulled loop in normal use is 0.7 inches. If a greater thickness of polyethylene sheath 8 were used, a greater length resistor 1 would be required to have the loop necessarily form in section not having the resistor at the midpoint of the loop when the loop is pulled. Conversely, if the thickness of polyethylene were reduced, then the resistor could be made shorter and still be incapable of remaining at the midpoint of a pulled loop.

The diameter of the resistors and conductive links is more or less controlled by the commercial acceptability of the cable for its intended use. In the present cable, intended for use with an electrostatic spray coating gun, the radial dimensions of the components can range between one-half to twice the value used in the preferred embodiment. This limitation results at the smaller diameter from the availability of resistors having the proper resistance value in a given diameter size. The upper limit of the diameter of these components is governed by the desirability to have a cable as small and flexible as possible. In a cable having dimensions in this range and made from the materials mentioned, the conductive links should be at least greater than 3 inches.

As an additional benefit of the use of these longer fiber glass resistors, it has become possible to use resistors having individual resistance values larger than has been previously possible. Therefore, fewer resistors can be used in order to give the same resistance per linear foot of a given cable. As a consequence, the conductive link can be made substantially longer than the minimum required. Further, the non-brittleness or toughness of the fiber glass rod structure enables the resistors themselves to withstand the mechanical stresses resulting from the normal flexing of the cable due to the interaction of the solid resistor with a moderately stiff dielectric sheath. The net result is a cable which is more flexible, and which exhibits the same safety features as the cable described in the prior art, but yet not exhibiting the frailties of the prior art cables; namely, mechanical stresses causing failure of either the dielectric sheath or the resistors themselves resulting from a pulled loop.

As an example of the advantages of the present construction for such a cable, cables have been successfully constructed and tested having the following characteristics:

a 25-foot cable having 10 resistors 1⅜ inches long with resistance value of 20 megohms each, connected by means of conductive links 30 inches long, and having other dimensions as in the preferred embodiment;

a 37-foot cable having 10 resistors 1⅜ inches long of 20 megohms eahc, with the resistors being connected by conductive links which are 45½ inches long and having other dimensions as in the preferred embodiment; and a 50-foot cable having 10 resistors 1⅜ inches long with resistance of 20 megohms each, being connected by means of conductive links 60 inches long and having other dimensions as in the preferred embodiment.

In each of these cables, the length of the resistor itself was chosen to be substantially longer than the minimum length required as described above. This added length provides a safety margin as far as the resistors remaining in a pulled loop, allows a greater range of resistance values for the individual resistors, if necessary, and results in a more flexible cable with improved structural integrity.

Figure 3:
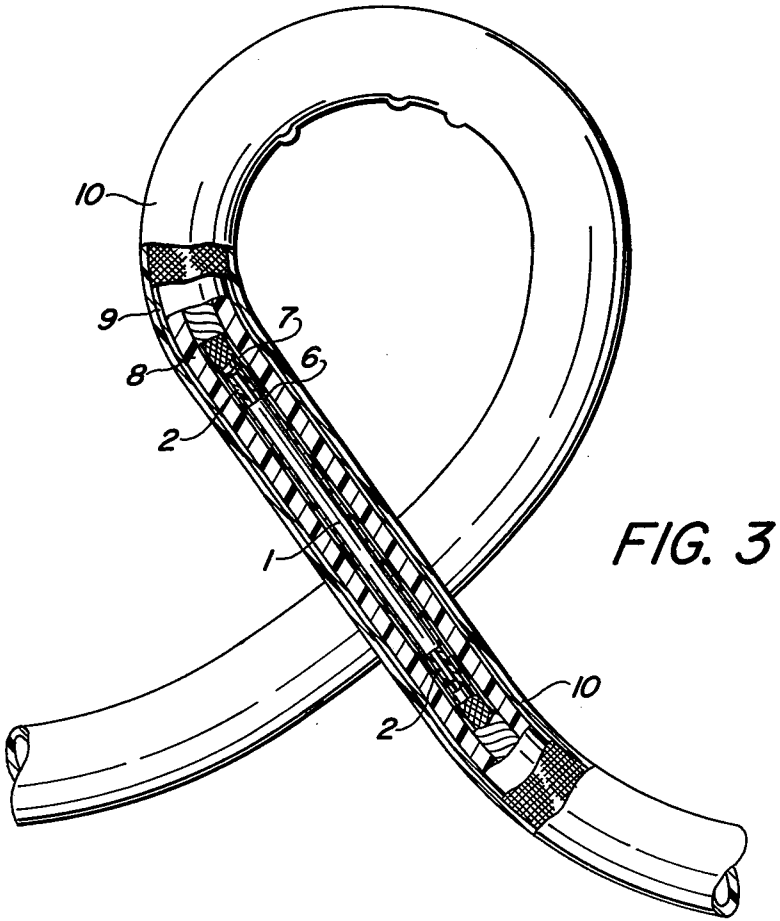
FIG. 3 shows an embodiment of the cable of the present invention with a pulled loop and showing a partial cross sectional view of the cable around the resistor.
Figure 2:
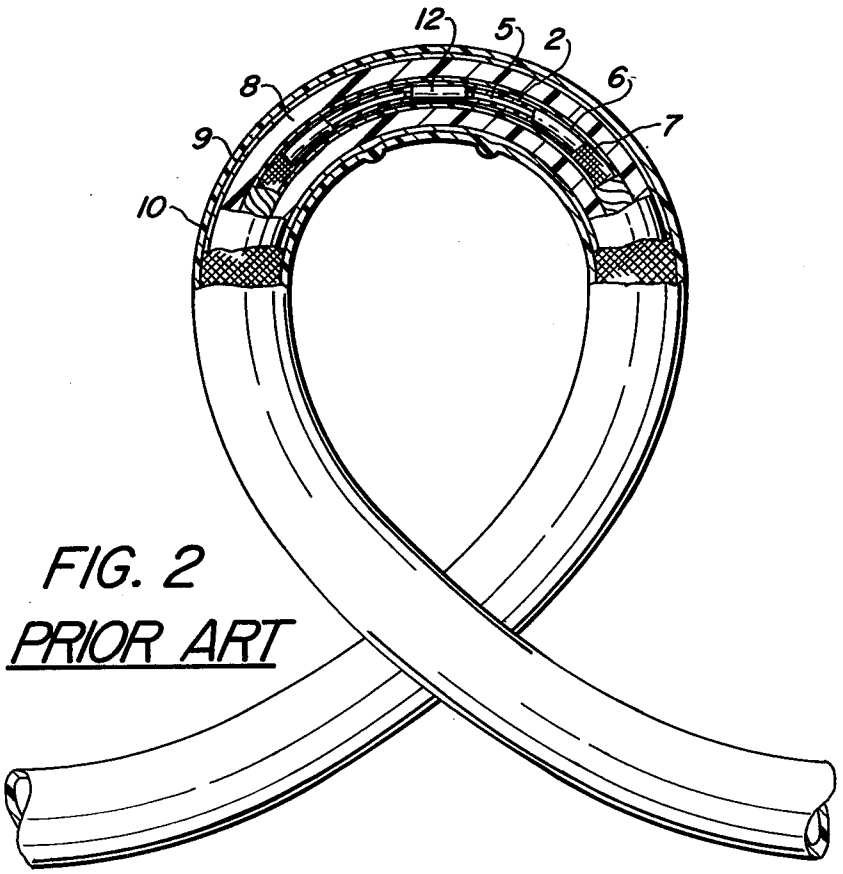
FIG. 2 PRIOR ART
FIG. 2 shows a prior art resistor core cable with a resistor in a small radius portion of a pulled loop wherein a partial cross sectional view of the cable is shown around the resistor.

The differences between the prior art cables and the cable incorporating the present invention can be more fully appreciated by comparative reference to FIGS. 2 and 3. FIG. 2 shows a prior art cable having a pulled loop formed in it, with a resistor 12 which is 0.25 inches long and located initially at the center of the loop. Such a situation is typical of the loops encountered in actual use, wherein a resistor can randomly be in any portion of the loop. If the ends of the cable of FIG. 2 are pulled, the length of the resistor is not long enough to cause the loop to form in any preferred location. Therefore, if the loop is pulled, reducing the radius of the loop, the solid resistor 12 will cause deforming stresses in the sheath 8: the sheath 8 is bent over both ends of the resistor 12; and the sheath 8 is stretched at its outer circumferential portion around the resistor 12. Further, if the resistor were a carbon composition resistor, the stresses would result in fracture of the resistor.

FIG. 3 shows a cable identical to the preferred embodiment, with a pulled loop in it. The length of the resistor is long enough to cause the loop to form in a portion of the cable such that the resistor is not at the midpoint of the loop when the is pulled.

Having described our invention, we claim:

1. An elongated electric cable for use in connecting an electrostatic spray coating gun to a source of high voltage electrical power comprising:

an electrical path comprising a core of a series of rigid elongated non-brittle resistors joined end to end by means of flexible elongated conductive links electrically connected between separate resistors;

a uniform continuous dielectric sheath which is substantially less flexible than the conductive links, which is flexurally elastic, which surrounds the core for its length and which will not permanently deform under normal flexing of the cable;

wherein the length of the resistor is longer than the shortest length of resistor which could remain at the midpoint of a loop when such a loop is pulled from the ends of the cable in normal use.

2. The apparatus of claim 1 wherein the sheath is high molecular weight low density polyethylene.

3. The apparatus of claim 1 wherein the length of the conductive links is at least as long as the minimum allowable loop length for the cable.

4. The apparatus of claim 1 wherein the resistor comprises a fiberglass rod made resistive.

5. The apparatus of claim 4 wherein the resistors and the links have substantially identical radial dimensions and the length of the conductive links is at least as long as the minimum allowable loop length for the cable.

6. An elongated electrical cable for use in connecting an electrostatic spray coating gun to a source of high voltage electrical power comprising:

an electrical path comprising a core of a series of rigid elongated non-brittle resistors joined end to end by means fo flexible elongated conductive links electrically connected between separate resistors;

a uniform, continuous, dielectric sheath which is substantially less flexible than the conductive links, which is flexurally elastic, which surrounds the core for its length, and which will not permanently deform under normal flexing of the cable;

wherein the elongated lengths of said resistors are great enough to necessarily prevent said resistors from remaining at the midpoint of a loop once such a loop is pulled in normal use from the ends of the cable.

7. The apparatus of claim 6 wherein the resistors and the links have substantially identical radial dimensions and the sheathing material has dielectric properties and flexural elasticity similar to high molecular weight low density polyethylene, has a radial thickness between 0.05 inches and 0.2 inches, and wherein the resistors are cylindrical with a diameter between 0.047 inches and 0.188 inches and with a length greater than 0.7 inches, and wherein the conductive link has an elongated length greater than 3 inches.

8. The apparatus of claim 6 wherein the resistors and the links have substantially identical radial dimensions and the sheath is high molecular weight low density polyethylene and wherein the sheath has a radial thickness between 0.05 inches and 0.2 inches, and wherein the resistors are cylindrical with a diameter between 0.047 inches and 0.188 inches and with a length greater than 0.7 inches, and wherein the conductive link has an elongated length greater than 3 inches.

9. The apparatus of claim 6 wherein the resistors and the links have substantially identical radial dimensions and the sheathing material is high molecular weight low density polyethylene and has an annular thickness between 0.05 inches and 0.2 inches and wherein the resistors are cylindrical with a diameter between 0.047 inches and 0.188 inches and with a length greater than 0.7 inches.

10. The apparatus of claim 9 wherein the length of the conductive links is at least as long as the minimum allowable loop length for the cable.

11. An elongated electric cable for use in connecting an electrostatic spray coating gun to a source of high voltage electrical power comprising:

an electrical path comprising a core of a series of rigid elongated non-brittle resistors joined end to end by means fo flexible elongated conductive links electrically connected between separate resistors;

a uniform, continuous, dielectric sheath which is substantially less flexible than the conductive links, which is flexurally elastic, which surrounds the core for its length, and which will not permanently deform under normal flexing of the cable;

wherein the elongated lengths of the resistors are long enough to cause the forces which arise in a cable from a loop with a resistor at the center and which tend to cause the resistor to travel to another position, exceed the forces resisting such travel when the loop is pulled tight in normal use.

12. An elongated electrical cable for use in connecting an electrostatic spray coating gun to a source of high voltage electrical power comprising:

an electrical path comprising a core of a series of rigid elongated non-brittle resistors joined end to end by means of flexible elongated conductive links electrically connected between separate resistors, the resistors and the links having substantially identical radial dimensions;

a uniform, continuous, dielectric sheath which is substantially less flexible than the conductive links, which is flexurally elastic, which surrounds the core for its length, and which will not permanently deform under normal flexing of the cable;

wherein the elongated length of the resistors is great enough to cause a loop with a resistor at the midpoint of the loop to become positionally unstable when the loop is pulled tight from its ends in normal use.

13. The apparatus of claim 12 wherein the length of the conductive links is at least as long as the minimum allowable loop length for the cable.

14. The apparatus of claim 12 wherein the resistors and the links have substantially identical radial dimensions and the length of the resistors is great enough to cause a loop with the resistor at the midpoint to become unstable before the cable has the minimum allowable radius bend at either end of the resistor in the loop when the loop is pulled tight from the ends of the cable in normal use.

15. The apparatus of claim 12 wherein the length of the conductive links is at least as long as the minimum allowable loop length for the cable.

* * * * *